US005584124A

United States Patent [19]

Marthaler et al.

[11] Patent Number: 5,584,124

[45] Date of Patent: Dec. 17, 1996

[54] TRIGGER-OPERATED PUNCH

[75] Inventors: Robert H. Marthaler, Elmhurst; Robert J. Long, Lake In The Hills, both of Ill.

[73] Assignee: ACCO USA, Inc., Wheeling, Ill.

[21] Appl. No.: 426,775

[22] Filed: Apr. 21, 1995

[51] Int. Cl.[6] ..... B26F 1/14

[52] U.S. Cl. ..... 30/363; 30/229

[58] Field of Search ..... 30/363, 364, 128, 30/229, 230, 251, 259

[56] References Cited

U.S. PATENT DOCUMENTS

| | | | |
|---|---|---|---|
| 341,756 | 5/1986 | Kirkpatrick . | |
| 869,949 | 11/1907 | Westerdahl | 30/257 |
| 2,769,237 | 11/1956 | Okhandler | 30/257 |
| 3,015,161 | 1/1962 | Semler et al. | 30/363 |
| 3,350,781 | 11/1962 | Bender | 30/363 X |
| 3,372,482 | 3/1968 | Mercorelli | 30/229 |
| 3,504,436 | 4/1970 | Ebert | 30/358 |
| 3,590,484 | 7/1971 | Walsh | 30/363 |
| 5,157,835 | 10/1992 | Wazarchik et al. | 30/85 |

FOREIGN PATENT DOCUMENTS

| | | | |
|---|---|---|---|
| 844117 | 7/1939 | France | 30/229 |

*Primary Examiner*—Douglas D. Watts
*Attorney, Agent, or Firm*—Pennie & Edmonds

[57] ABSTRACT

A sheet punch assembled of a plurality of molded parts having a handle section with a stationary jaw and a trigger section pivotal about the handle section which trigger section has a movable jaw. The handle and trigger are oriented at about a right angle to the sheet to be punched. Punched discs are collected initially in the stationary jaw and caused to thereafter move into a trigger chamber having an exit door.

13 Claims, 7 Drawing Sheets

TRIGGER-OPERATED PUNCH

BACKGROUND OF THE INVENTION

Prior punches have employed pivotal grip handles (U.S. Pat. No. 341,756 and U.S. Pat. No. 3,261,073) and the paper sheets to be punched have been oriented at an angle to the grip handles (U.S. Pat. No. 4,072,554). Paper guides have also been proposed (U.S. Pat. No. 3,590,484).

SUMMARY OF THE INVENTION

Broadly, the present invention a molded punch for punching a sheet having jaws with handles where one handle is rotatable about a pivot point and where the handles are oriented at a substantial angle to the sheet.

It is a feature that the punch is composed of molded plastic parts including two housing parts held together when assembled by a forced fit arrangement.

Further, features are a handle disc collection container, die hole surfaces composed of the same material as the handle covers portions and a punch pin configuration.

Finally, it is a feature of the punch product that it is hangable on a display card.

DESCRIPTION OF THE PREFERRED EMBODIMENT

Figure 1:
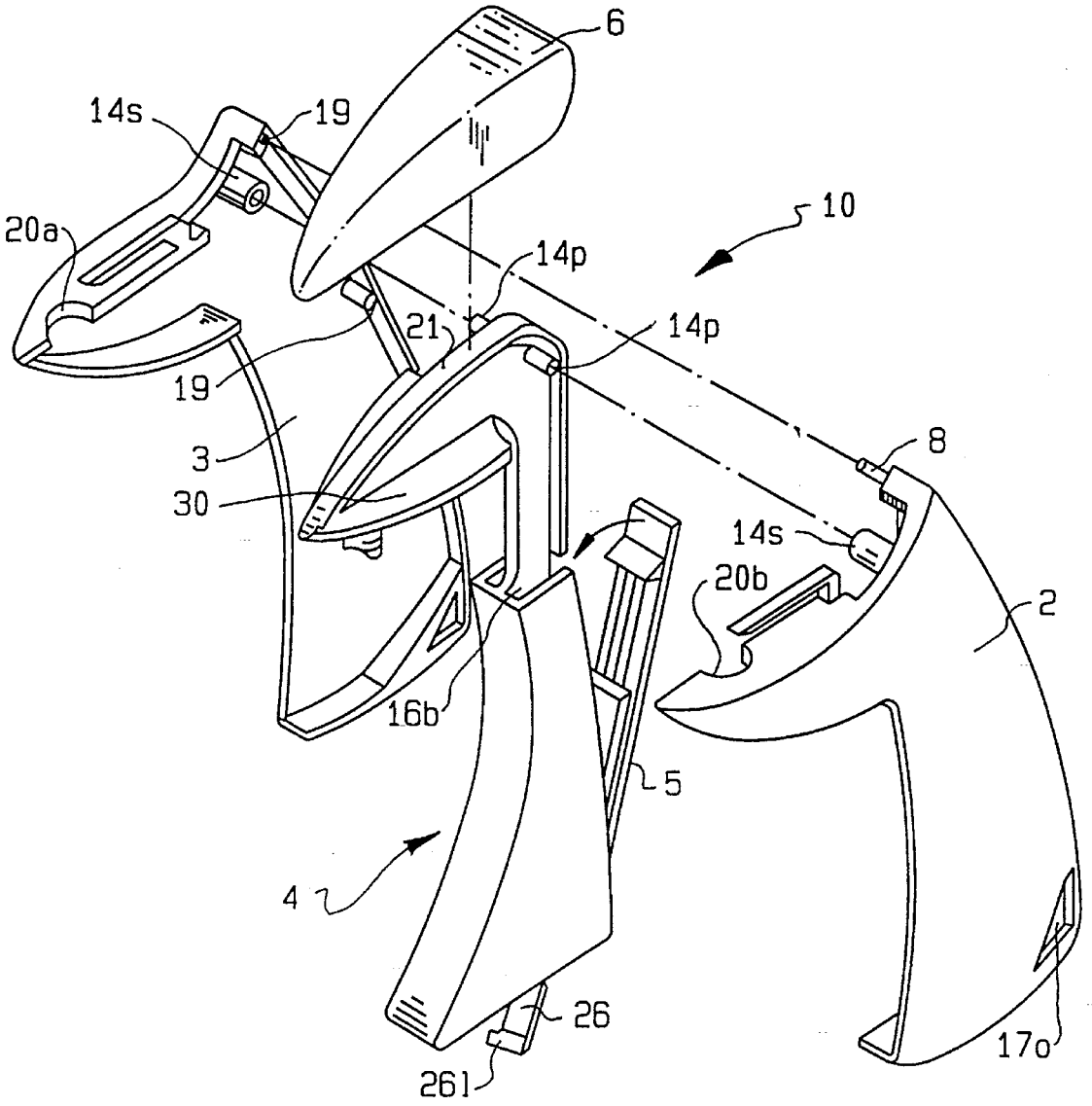
FIG. 1 is an exploded perspective view of the punch of the present invention including five (5) molded sections including a trigger section with a beak top section.

In the FIGS. 1–7, punch 10 comprises five (5) molded casing sections; half sections 2, 3, center trigger section 4 including insert section 5 and top beak cover section 6. Sections 2, 3 and 4 are aligned along hinge pin unit 14 including pins 14*p* and recess sockets 14*s*. Casing projection fasteners 8 are forced fitted into holes 19 (several of which are shown) to connect casing sections 2, 3 around center trigger section 4.

Figure 3:
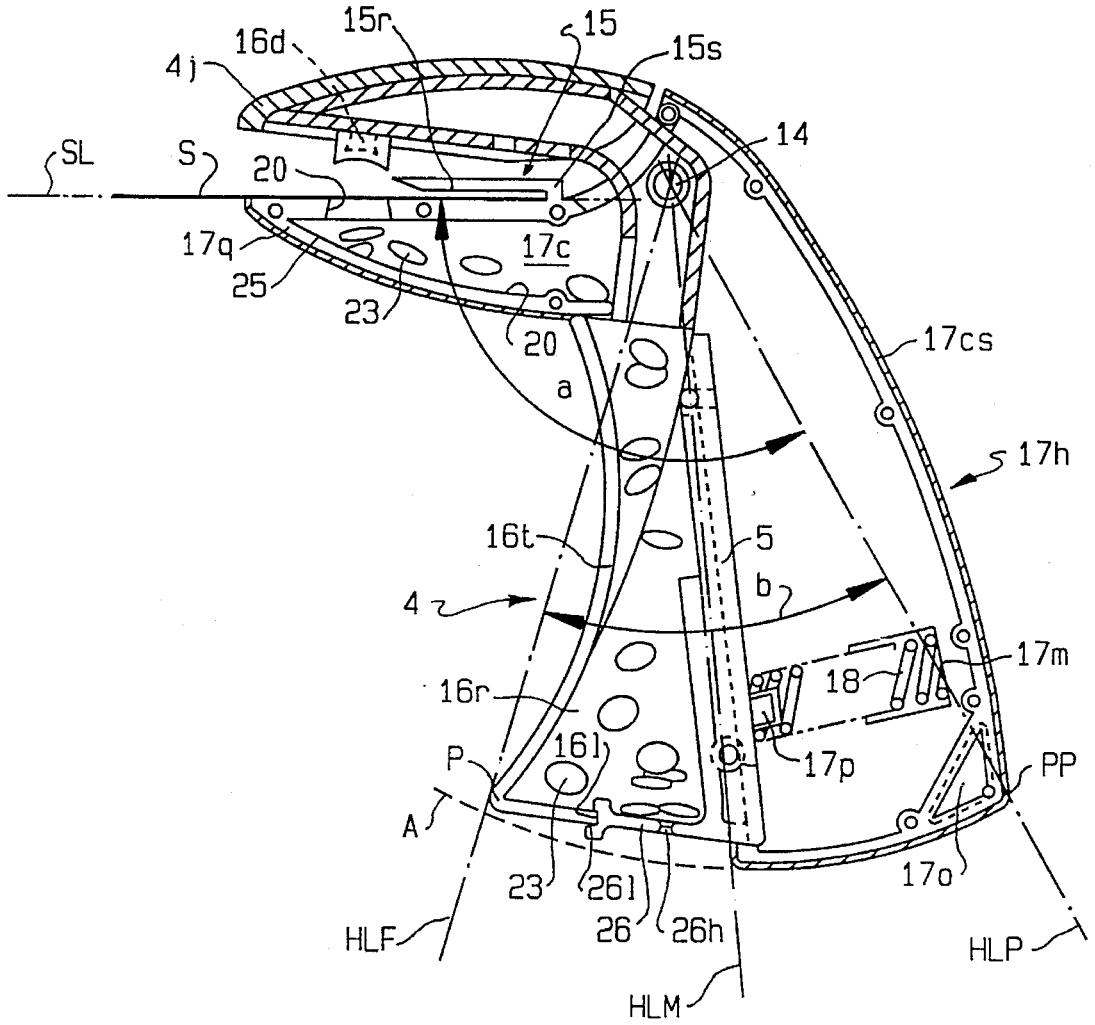
FIG. 3 is a left elevational sectional view of the punch in its open position.

Turning to FIG. 3, punch 10 includes handle section 17*h* comprising sections 2, 3, convex hand support rear surface 17*cs*, lower jaw 17*g*, and hanger opening 17*o*. Punch 10 also includes spring recess mount 17*m* on handle section 17*h* which captures spring 18 around its outside diameter and stud 17*p*, molded as part of insert 5 controls the inside surface of spring 18. Lower jaw 17*g* of casing sections 2, 3 carries paper limit and hold-down guide 15. Guide 15 has vertical sheet stop 15*s* and horizontal hold-down rail 15*r*. Also shown is die hole 20 defined by two (2) semicircular walls 20*a*, 20*b* on sections 2, 3. Die hole 20 has upper opening 20*u* and lower opening 201. Walls 20*a*, 20*b* are at about a 10° angle w to vertical v. Circular opening 20*u* is smaller in diameter than circular opening 201 to provide an additional volume below opening 20*u* (which opening determines the punched disc size) so that discs 23 can expand after their formation as discs which expansion assists in preventing discs 23 from moving upwardly through opening 20*u* when the punch pin 32 moves upward after punching of the sheet S.

Trigger 4 includes upper jaw 4*j* with stud 16*d* for mounting of metallic punch pin 32. Trigger 4 also includes trigger hand-support concave contour body 16*t* with paper punch ring or disc container 16*r*. Punch rings 23 as punched out of sheet S pass from lower jaw chamber 17*c* into trigger unit 4 (see FIGS. 3, 4 and 7). Upper trigger 4 entrance portion 16 is divided into two (2) ring receiver entrance areas 16*a*, *b* (See FIG. 7). Finally, rings 23 collect in the bottom of chamber 16*r* and are emptied through hinged door 26. Door 26 swings about flexible hinge 26*h* which is integral with the rest of insert 5. Door 26 includes latch configuration 26*l* which engages chamber lip 16*l* to hold door 26 closed.

Figure 2:
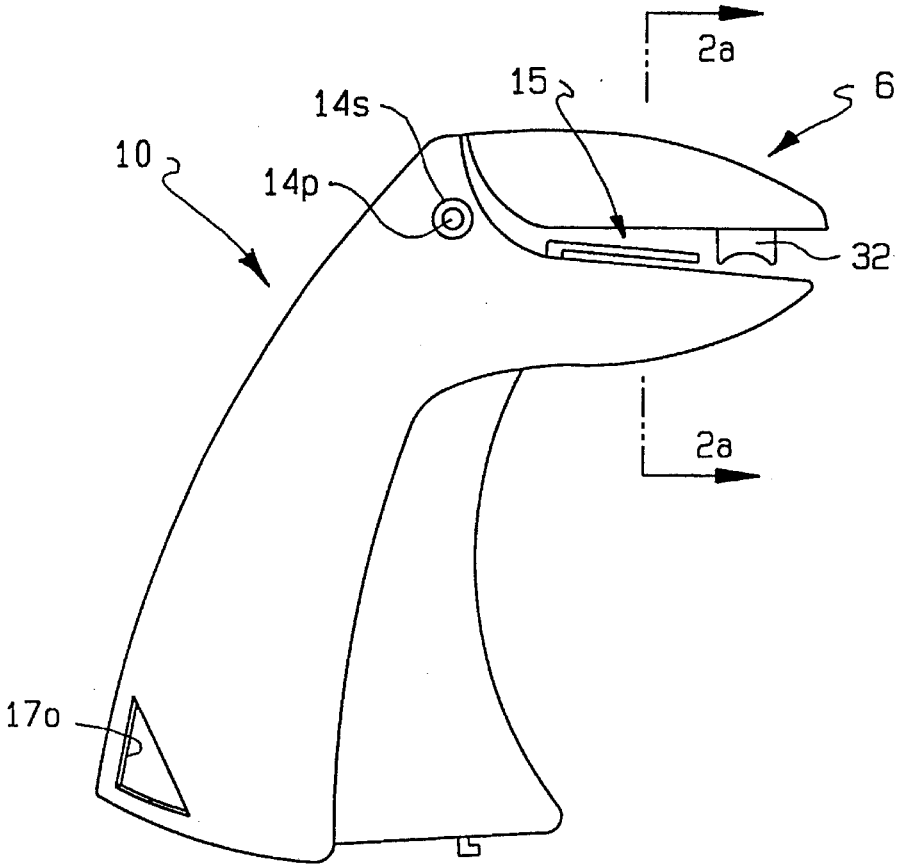
FIG. 2 is a right side elevational view of the punch.
Figure 2A:
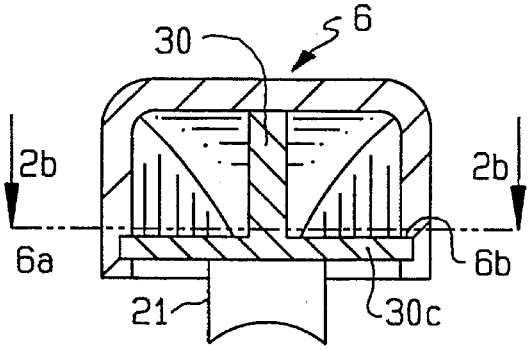
FIG. 2*a* is a sectional view along line 2*a*—2*a* of FIG. 2 showing attachment of the beak top section.
Figure 2B:
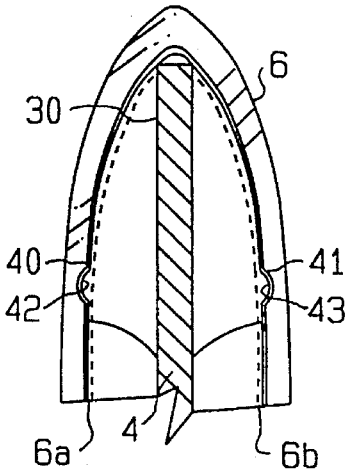
FIG. 2*b* is a sectional view along line 2*b*—2*b* of FIG. 2*a;*

In FIG. 2*b* it is seen that grooves 6*a*, 6*b*, located in cap 6, each have an indentation 40, 41 respectively. Horizontal portion 30*c* also has curved protrusions 42, 43 which snap into indentations 40, 41 after cap 6 has been slid along portion 30*c* a certain distance. This arrangement locks cap 6 in place without adhesives or other connectors.

In FIG. 2*a* the sliding force-fit connection of cap 6 with grooves 6*a*, 6*b* on trigger portion 30*c* is shown.

Figure 4:
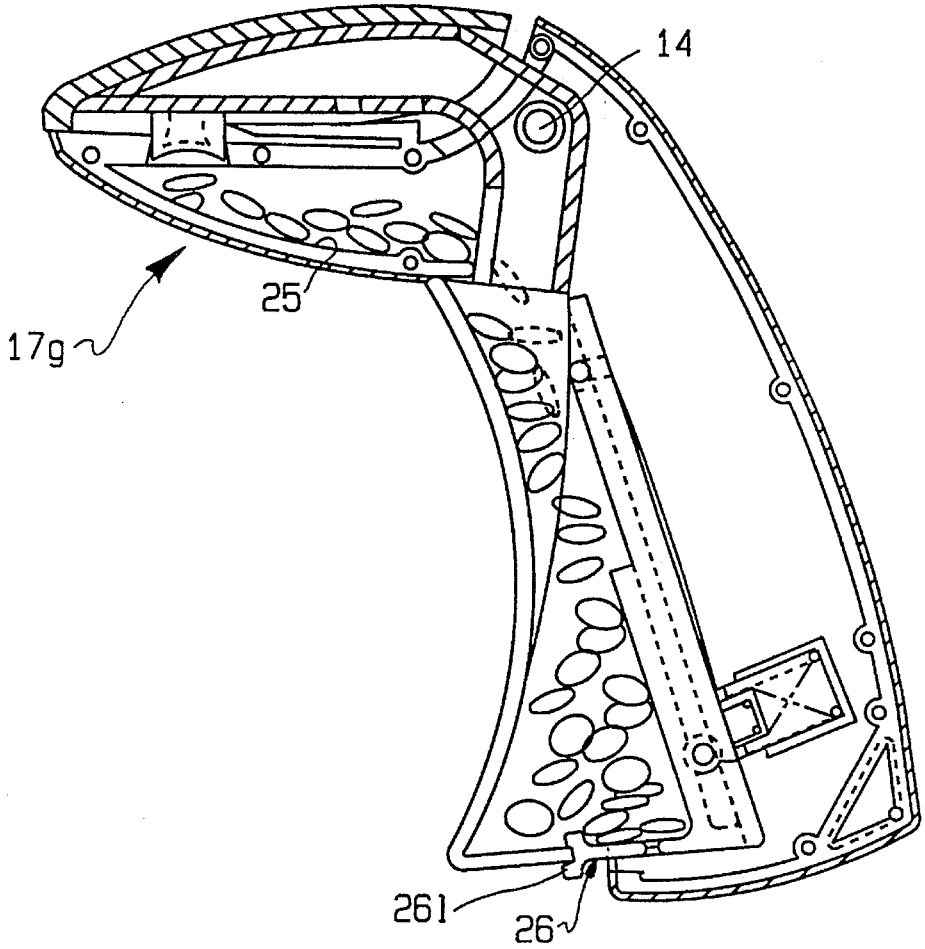
FIG. 4 is a view the same as FIG. 3 except the punch is in its closed position.
Figure 5:
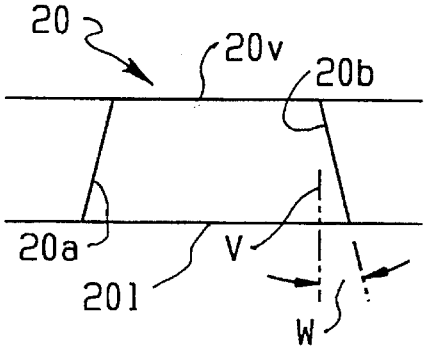
FIG. 5 is an enlarged elevational section showing the punch die hole.
Figure 6:
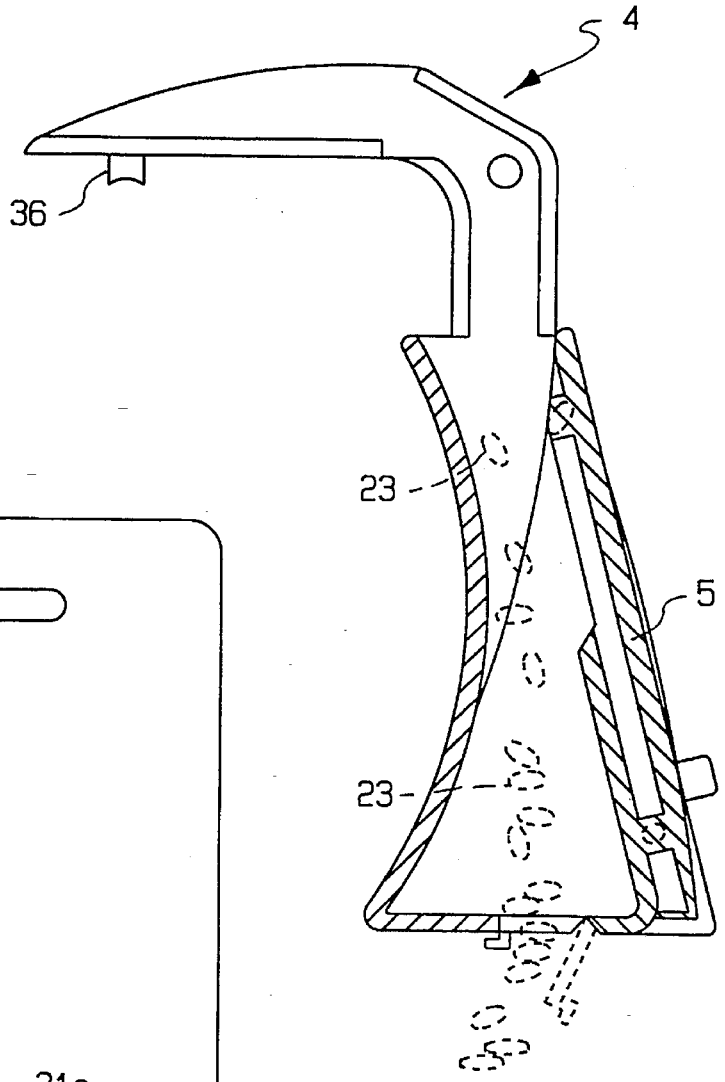
FIG. 6 is a partial sectional side elevational view of the trigger, a trigger insert with a door ajar.
Figure 7:
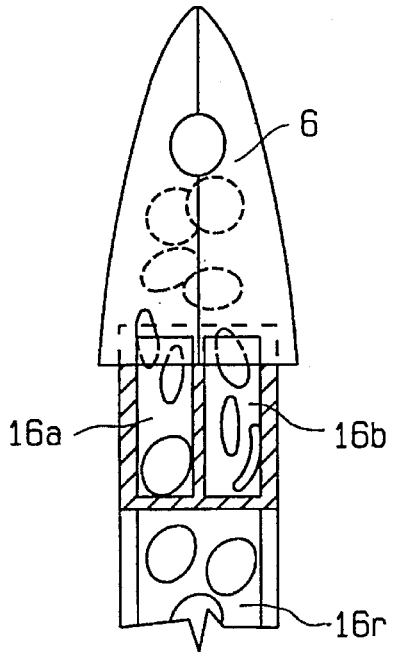
FIG. 7 is a plan view with a cut-away showing travel transition of punch discs from base section beak to trigger container.

FIGS. 4 and 7 show how cutout sheet rings 23 travel along curved jaw surface 25 of lower jaw 17*g* located in base handle section 17*h* to compartment 16*r* in trigger section 16.

Figure 8:
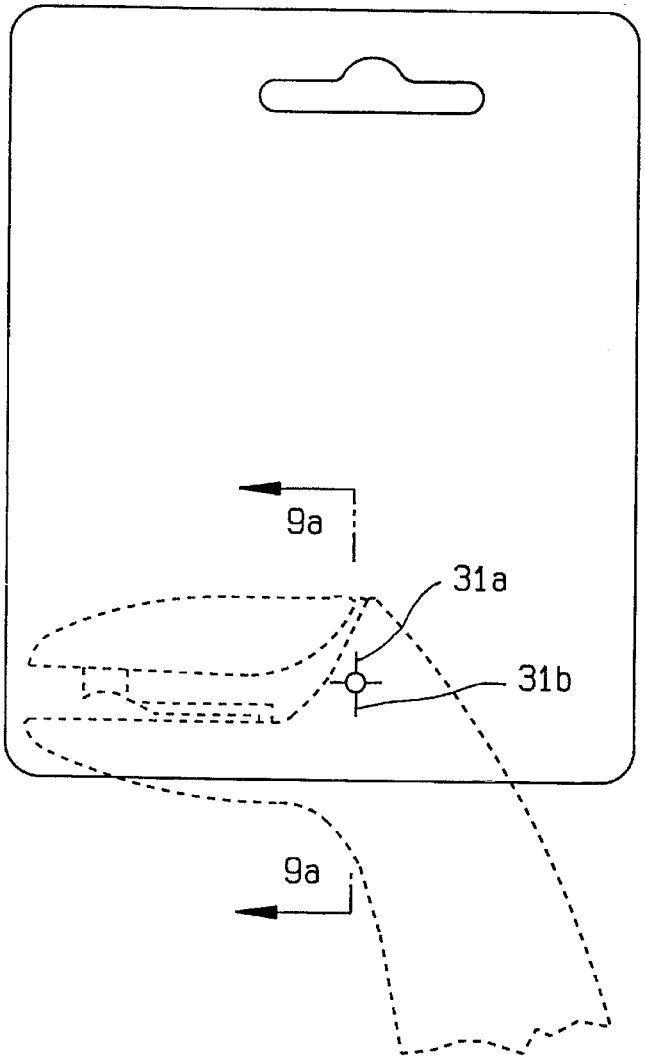
FIG. 8 is a punch display card with a button holder.
Figure 9:
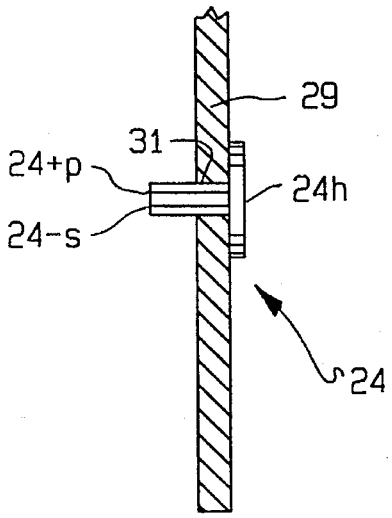
FIG. 9 is a sectional view showing a button stud assembled on a display card.
Figure 9A:
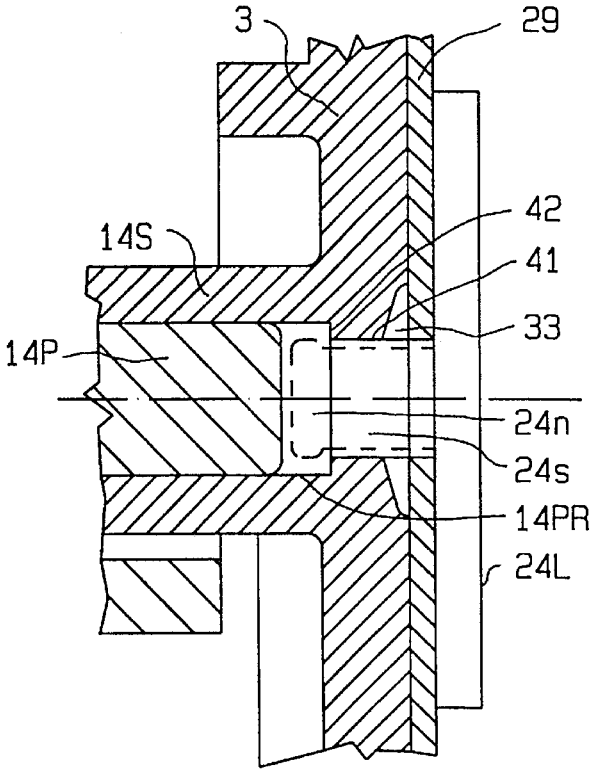
FIG. 9*a* is a sectional view along line 9*a*—9*a* of FIG. 8.

In FIGS. 8, 9 and 9*a*, display card 29 has hole 31 formed by cross cuts 31*a*, 31*b*. Button card stud 24 is inserted through hole 31 until head 24*h* engages card 29. Card stud 24 also includes stem 24*s*. Punch 10 has an exterior side opening 33 in casing section 3 in socket 14*s*.

Contained in socket 14*s* as part of section 3 is tapered bore 41 terminating in shoulder bore portion 42. Shoulder bore portion 42 has a diameter which is smaller than the diameter of stud stem 24*s*. When stud stem 24*s* is placed through casing opening 33 and press fitted through the taper bore portion 41, tip stem portion 24*tp* of stem 24*s* (FIG. 9) is compressed to pass beyond the shoulder bore portion 42 into pivot pin passageway 14*pr*. As tip portion 24*tp* enters passageway 14*pr* it restores itself to form a mushroom head 24*m* as shown in dashed lines in FIG. 9*a*. Head 24*m* provides engagement by resisting withdrawal of stem 24*s*. Polypropylene stud 24 is softer and more deformable than casing section 3.

Figure 10:
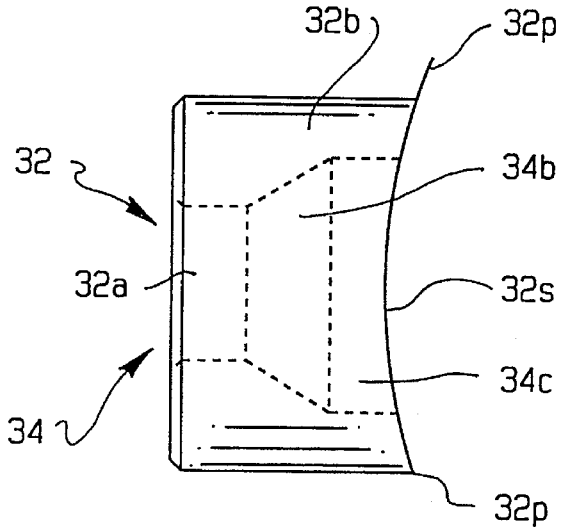
FIG. 10 is a front elevational view of the punch pin.
Figure 11:
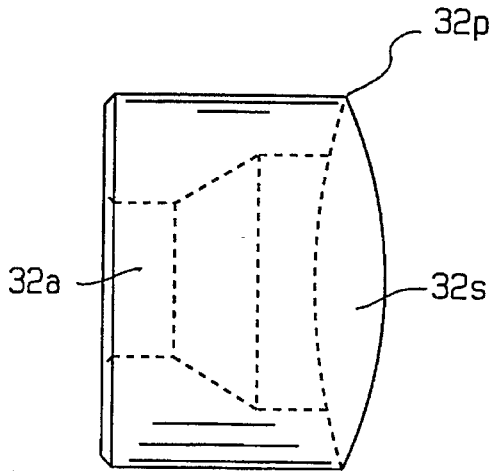
FIG. 11 is a side elevational view of the pin.
Figure 12:
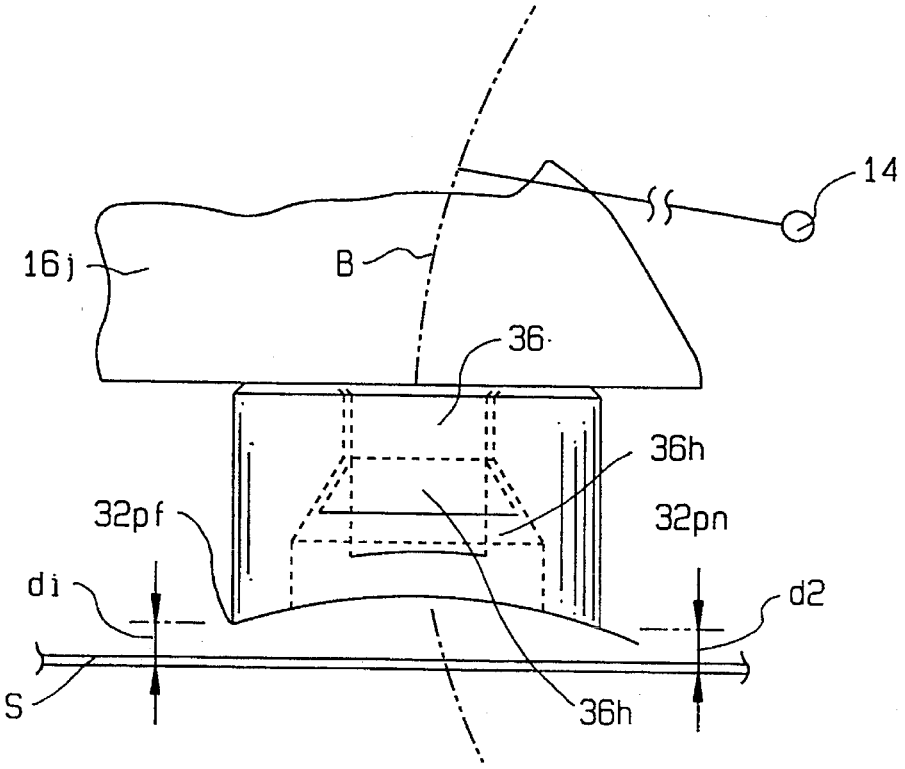
FIG. 12 is a sectional view of the upper jaw showing the pin held by a jaw stud.

Turning to FIGS. 10–12, punch pin 32 has cylindrical body 32*b* and concave cutting surface 32*s* including cutting perimeter 32*p* with center hole 34 therein. Hole 34 includes first diameter portion 34*a*, mid portion 34*b* and last portion 34*c*. The first and last portions 34*a*, 34*c* are cylindrical in shape.

Punch 32 is mounted on jaw stud 36 located on upper jaw 4*j* which stud 36 is initially cylindrical in shape (see solid lines in FIG. 12). Upon placing pin 32 on stud 36 during assembly, stud 36 is deformed by heat and pressure to cause stud 36 to take a head shape 36*h* (shown in dotted lines in FIG. 12). Stud head 36*h* cannot pass through pin portion 34*a* thus holding pin 32 in place on jaw 4*j*.

Further shown in FIG. 12 is pivot 14 and the arc B through which pin 32 swings during its punching a punch hole in sheet S. The arc B and sheet S are positioned such that the punch perimeter portion 32*pn* nearest pivot 14 engages sheet S before the perimeter portion 32*pf* further away engages sheet S. Distance $d_2$ is smaller than distance $d_1$.

Turning back to FIG. 5 the opening 20 composed of semi-circular surfaces 20*a* of section 3 and 20*b* of section 2. Surfaces 20*a, b* are made of same material as sections 2, 3 which preferably is about 70% nylon and 30% glass fibers (by volume). Due to the hardness and wear properties of the materials of sections 2, 3, hole 20 provides a good cutting surface in cooperation with cylindrical metal punch pin 32. Insert 5 is made of polypropylene (FIG. 1).

In the operation of punch 10, the operator's hand grips the punch handle portion engaging surfaces 17*cs*, 16*t* at an angle to line SL which is substantially 90° from line SL. Line SL lies in the plane of the to-be-punched sheet S. Handle position relative to line SL is measured by handle lines HL which pass through axis pin 14 and points P, PP on arc A (which arc is inscribed about point 14). There is a range of handle lines (HL) between P and PP intersecting arc A including forward handle line HLF, middle handle line HLM and rear handle line HLR. The angle a between lines HLR and SL is preferably about 120 degrees and the angle b between lines HLF and HLR is preferably about 45° providing a range of 75°. These angles between hand grip and sheet S provide ergonomic ease of use by the punch operator even when repeated use is required.

We claim:

1. A trigger-operated punch adapted for punching an object positioned in a plane, comprising:

a) a base handle section defined by two half sections connected together, said base handle section including a stationary first jaw portion having an upper surface, extending substantially parallel to said plane, and a rear surface extending downwardly away from said plane;

b) a pivot axis means on said base handle section at a location at least adjacent said plane, said pivot axis means extending in a direction parallel to said plane;

c) a trigger handle section pivotally mounted between the two half sections of the base handle section, said trigger handle section including a movable second jaw portion overlying said first jaw portion in spaced relation thereto, said trigger handle section being mounted on said pivot axis means for pivotal movement of said second jaw portion toward and away from said first jaw portion, said trigger handle section further including a forward surface extending downwardly away from said plane;

d) a punch pin positioned on one of said first and second jaw portions;

e) a die hole defined in the other of said first and second jaw portions for receiving said punch pin upon movement of said jaw portions toward each other; and f) said rear surface of the base handle section and said forward surface of the trigger handle section being located so that they are adapted to be gripped by an operator's hand at an angle of substantially 90° to said plane.

2. A trigger-operated punch adapted for punching a sheet positioned in a plane, comprising:

a) a base handle section including a stationary first jaw portion having an upper surface, extending substantially parallel to said plane, and a rear surface extending downwardly away from said plane to a lower rear point;

b) a pivot axis means on said base handle section at a location at least adjacent said plane, said pivot axis means extending in a direction parallel to said plane;

c) a trigger handle section including a movable second jaw portion overlying said first jaw portion in spaced relation thereto, said trigger handle section being mounted on said pivot axis means for pivotal movement of said second jaw portion toward and away from said first jaw portion, said trigger handle section further including a forward surface extending downwardly away from said plane to a lower front point;

d) a punch pin positioned on one of said first and second jaw portions;

e) a die hole defined in the other of said first and second jaw portions for receiving said punch pin upon movement of said jaw portions toward each other;

f) said pivot axis means, said lower rear point, and said lower front point being located relative to each other and said plane wherein:

i) a first straight line, extending through said pivot axis means and said lower rear point of the base handle section, defines an angle of about 120° relative to said plane, and ii) a second straight line, extending through said pivot axis means and said lower front point of the trigger handle section, defines an angle of about 45° relative to said first straight line.

3. The trigger-operated punch of claim 2, wherein said base handle section is defined by two half sections connected together with said trigger handle section pivotally mounted therebetween.

4. The trigger-operated punch of claim 3, wherein said half sections each have a semicircular opening which face each other to define said die hole.

5. The trigger-operated punch of claim 4, wherein said half sections are constructed of nylon and glass fibers to define said die hole.

6. The trigger-operated punch of claim 2, wherein said rear surface is convex and said forward surface is concave.

7. The trigger-operated punch of claim 2, wherein said punch pin is positioned in said second jaw portion, and said base handle section includes a stripper sheet guide formed integrally therewith and disposed below said movable second jaw portion and at a spaced location above said upper surface of said stationary first jaw portion, said stripper sheet guide extending between said pivot axis means and said punch pin for holding a sheet positioned on said upper surface against movement off of said upper surface as said jaw positions are moved away from each other and said punch pin moves through said sheet and said die hole.

8. The trigger-operated punch of claim 2, wherein said trigger handle section defines a hollow housing having opposite ends and a closed interior in communication with said die hole at one of said ends adapted for receiving sheet punch blanks punched by said punch pin from sheets positioned on the upper surface of said first jaw portion.

9. The trigger-operated punch of claim 8 wherein said housing includes a hinged door at the other of said ends for providing selective access to said interior to remove sheet punch blanks collected in said interior.

10. The trigger-operated punch of claim 2, further including a spring disposed between said base handle section and said trigger handle section and normally urging said trigger handle section rotatively about said pivot axis means to position said movable second jaw portion in said spaced relation to said first jaw portion.

11. A trigger-operated punch adapted for punching an object positioned in a plane, comprising:

a) a base handle section including a stationary first jaw portion having an upper surface, extending substantially parallel to said plane, and a rear surface extending downwardly away from said plane;

b) a pivot axis means on said base handle section at a location at least adjacent said plane, said pivot axis means extending in a direction parallel to said plane;

c) a trigger handle section including a movable second jaw portion overlying said first jaw portion in spaced relation thereto, said trigger handle section being mounted on said pivot axis means for pivotal movement of said second jaw portion toward and away from said first jaw portion, said trigger handle section further including a forward surface extending downwardly away from said plane;

d) a punch pin positioned on one of said first and second jaw portions; and e) a die hole defined in the other of said first and second jaw portions for receiving said punch pin upon movement of said jaw portions toward each other, wherein said base handle section is defined by two half sections connected together with said trigger handle section pivotally mounted therebetween, said half sections each having an integrally-formed opening which face each other to collectively define said die hole.

12. A trigger-operated punch adapted for punching an object positioned in a plane, comprising:

a) a base handle section including a stationary first jaw portion having an upper surface, extending substantially parallel to said plane, and a rear surface extending downwardly away from said plane;

b) a pivot axis means on said base handle section at a location at least adjacent said plane, said pivot axis means extending in a direction parallel to said plane;

c) a trigger handle section including a movable second jaw portion overlying said first jaw portion in spaced relation thereto, said trigger handle section being mounted on said pivot axis means for pivotal movement of said second jaw portion toward and away from said first jaw portion, said trigger handle section further including a forward surface extending downwardly away from said plane;

d) a punch pin positioned on said second jaw portion; and e) a die hole defined in said first jaw portion for receiving said punch pin upon movement of said jaw portions toward each other, wherein said trigger handle section defines a hollow housing having opposite ends and a closed interior in communication with said die hole at one of said ends adapted for receiving object punch blanks punched by said punch pin from objects positioned on the upper surface of said first jaw portion.

13. The trigger-operated punch of claim 12, wherein said housing includes a hinged door at the other of said ends for providing selective access to said interior to remove object punch blanks collected in said interior.

* * * * *